United States Patent [19]

Armstrong

[11] 3,969,305

[45] July 13, 1976

[54] METHOD OF MAKING AN ACRYLIC SPINNING SOLUTION

[75] Inventor: Arthur A. Armstrong, Cary, N.C.

[73] Assignee: Monsanto Company, St. Louis, Mo.

[22] Filed: Dec. 26, 1973

[21] Appl. No.: 428,497

[52] U.S. Cl. ..... 260/32.6 N; 260/30.8 DS; 260/34.2

[51] Int. Cl.[2] ..... C08J 3/08; C08K 5/20; C08K 5/41; C08L 32/20

[58] Field of Search.... 260/34.2, 29.6 AN, 30.8 DS, 260/32.6 N

[56] References Cited

UNITED STATES PATENTS

| | | | |
|---|---|---|---|
| 3,463,616 | 8/1969 | Corradi et al. | 260/32.6 N |
| 3,574,177 | 4/1971 | Nakajima et al. | 260/32.6 N |
| 3,630,986 | 12/1971 | Mison et al. | 260/29.6 AN |

*Primary Examiner*—Allan Lieberman
*Attorney, Agent, or Firm*—Robert L. Broad, Jr.

[57] ABSTRACT

The method of making an acrylic spinning solution wherein a wet acrylonitrile-containing polymer is mixed with a solvent for the polymer to form a slurry, the slurry then being heated under pressure to obtain a polymer solution wherein the polymer is in solution in the solvent. The polymer solution is then passed through an elongated vaporization zone in which the pressure is decreased along the zone to provide a predetermined pressure profile along the length of the zone. The pressure profile through the zone is maintained above the polymer gel profile to remove most of the water while keeping the polymer in solution throughout the vaporizaton zone.

3 Claims, 5 Drawing Figures

METHOD OF MAKING AN ACRYLIC SPINNING SOLUTION

BACKGROUND OF THE INVENTION

One conventional method of making acrylonitrile-containing polymers for the production of filaments and fibers begins with an aqueous polymerization process. Following polymerization a filtering process removes most of the water, leaving a wet polymer cake. The polymer cake is then heated to drive off the remaining water and dry the polymer. The dry polymer is subsequently dissolved in a solvent to form a dope which is spun into filaments. Disadvantages of this process are that a substantial amount of energy is required to dry the polymer and that heating the polymer for the purpose of drying can easily degrade the polymer.

U.S. Pat. No. 3,313,758 avoids the drying of the polymer by forming a wet polymer cake and then washing the wet cake with a non-solvent for the polymer to remove a portion of the water and then by washing with a solvent for the polymer for removing more of the water and some of the non-solvent. The disadvantage of this process is that a considerable amount of washing is required and the problem of recovery of the non-solvent is added.

U.S. Pat. No. 3,630,986 avoids the drying of the polymer by mixing a solvent for the polymer with a wet polymer and evaporating off a major portion of the water by the use of a thin film evaporator operated under vacuum. The disadvantage of this process is that the process must tread a thin line between evaporation of the water and high viscosities which will prevent operation of the thin film evaporator. In this process the thin film evaporator must be operated below 100 mm Hg absolute pressure to keep the polymer solution viscosity low enough for operation (below 1,000 poises). This imposes equipment and process limitations.

French Pat. No. 1,266,100 avoids the polymer drying by washing the wet polymer with a solvent such as dimethylformamide to reduce the water content of the polymer. Unfortunately, this process requires several successive washes and thereby multiplies the solvent recovery problem.

One of the objects of this invention is to provide a novel and improved process for preparing spinning solutions of acrylonitrile polymers.

Another object of this invention is to provide a method for making spinning solutions of acrylonitrile polymers obtained from an aqueous polymerization process without the necessity of a drying step.

Other objects and advantages of the invention will become apparent when the following detailed description is read in conjunction with the drawings in which FIG. 1 is a schematic drawing showing apparatus for carrying out the process of the invention;

One embodiment of this invention contemplates making an acrylonitrile spinning solution from a wet polymer by mixing the wet polymer with a solvent for the polymer to form a polymer slurry, then heating the slurry under a pressure and at a temperature sufficient to dissolve the polymer in the solvent to form a polymer solution. The polymer solution is passed through an elongated vaporization zone for removal of most of the water. The pressure along the length of the vaporization zone is decreased in such a manner that pressures at points in this zone define a pressure profile which decreases along the zone, the pressure profile being sufficiently high to flash vaporize the water from the polymer solution while maintaining the polymer in solution.

Figure 1:
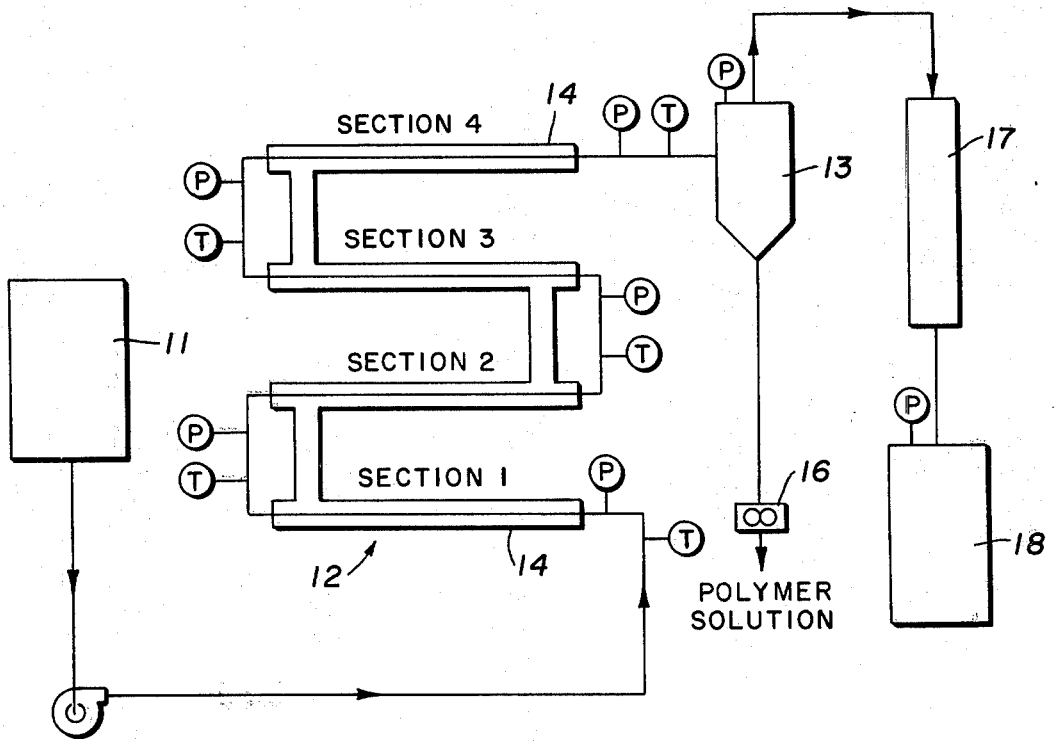

FIG. 1 shows apparatus for carrying out the process of this invention. A slurry tank 11 is provided for mixing and heating a polymer slurry. After the polymer slurry has been mixed and heated to a predetermined condition the slurry is fed through sections 1, 2, 3 and 4 of heat exchanger 12 to a cyclone separator 13. A steam jacket 14 is used to heat the sections of the heat exchanger to the desired temperature. A solution of polymer in solvent is taken off the bottom of the separator 13 through a gear pump 16 and may be fed directly to a spinning machine (not shown). Water vapor is taken off overhead from the separator and fed through a condenser 17 to condensate recovery 18. Any solvent in the vapor stream may be recovered in a conventional manner.

Feed to the slurry tank 11 comprises a mixture of water with an acrylonitrile-containing polymer and solvent for the polymer. Any solvent for acrylic polymer can be used if its boiling point is above that of water. Preferred solvents are dimethylacetamide, dimethylformamide and dimethylsulfoxide. The term "acrylonitrile-containing polymer" as used herein means filament-forming polymer containing a substantial proportion of acrylonitrile units, more particularly an acrylic polymer containing at least 85 percent by weight of acrylonitrile units or a modacrylic polymer containing 35 to 85 percent by weight of acrylonitrile units. The slurry may be made up of 5 to 20 weight percent polymer, 5 to 20 weight percent water and 70 to 80 weight percent solvent. Preferably, the slurry is made up of 8 to 12 weight percent polymer, 12 to 17 weight percent water and 73 to 77 weight percent solvent.

Figure 2:
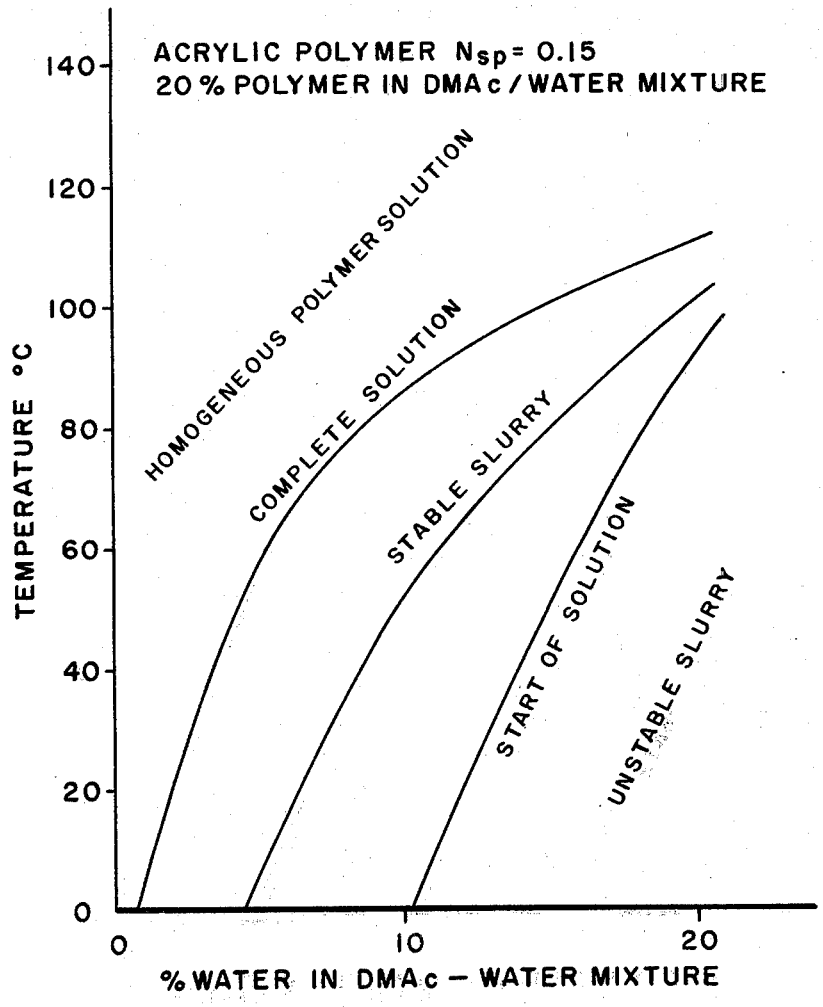
FIG. 2 is a chart showing conditions of the polymer solution during the preheating step.

FIG. 2 illustrates slurry conditions at various temperatures and water contents. At lower temperatures and higher water contents the slurry is unstable and the polymer particles will tend to settle out of the slurry unless the slurry is agitated. At this point the polymer is in solid form in a solvent-water mixture hving a low viscosity. As the temperature is increased and/or water is decreased, a point is reached where the polymer will start into solution. At this point the viscosity of the liquid portion of the slurry will begin to increase. As the temperature is increased and/or the water content is decreased further, solutioning proceeds to a point where the liquid viscosity is sufficiently high to prevent settling of polymer particles, making the slurry stable (refer to FIG. 2). As the temperature is increased still further and/or the water content is decreased further, the polymer will go completely into solution and will continue to move further out into the complete solution region as the temperature is increased and the water content is decreased. The curve indicated by the words "complete solution" in FIG. 2 might be called the "solution profile" or the "gel profile", since it is the boundary between complete solution and gelation (at least partially) of the polymer. In carrying out the process of this invention the pressure profile through the heat exchanger 12 would lie, if plotted on FIG. 2, above the solution or gel profile (i.e., the curve indicated by the term "complete solution").

Figure 3:
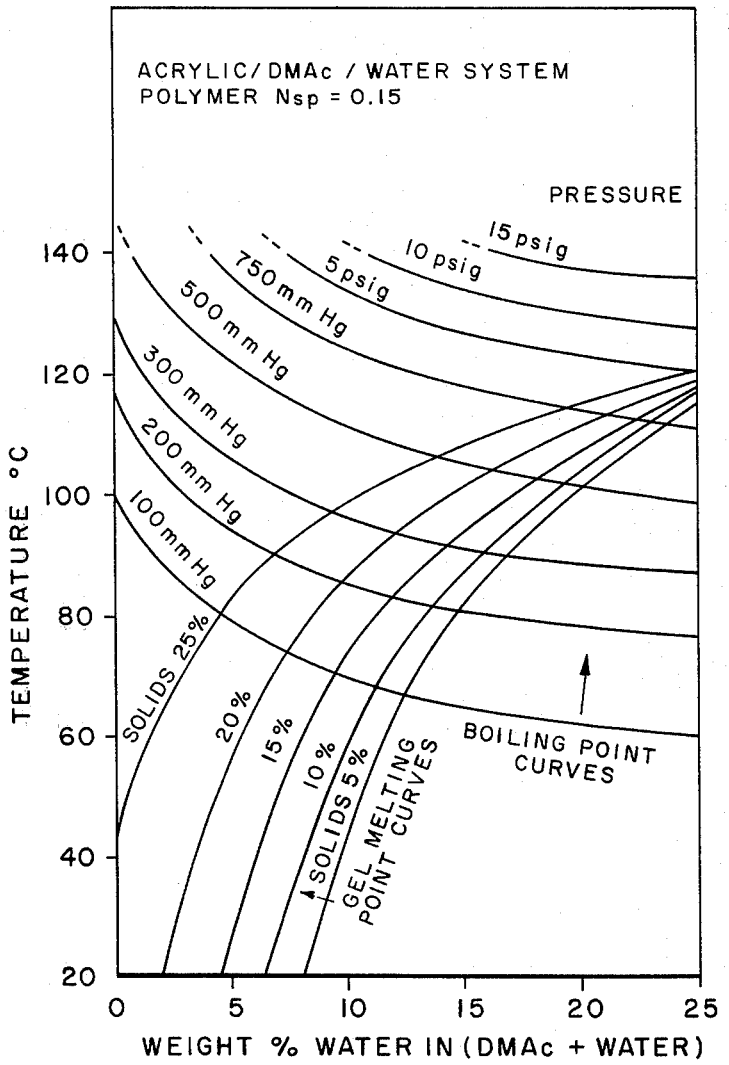
FIG. 3 is a chart showing gel or solution profiles for several polymer solutions and pressure curves from which a pressure profile for each solution can be determined.

FIG. 3 shows gel profiles or solution profiles for polymer solutions containing various amounts of water and polymer. Also plotted on this chart are pressures so that one may readily determine a pressure profile for a given polymer solution as it passes through the sections of the heat exchanger 12. For example, assume that a given polymer solution has a water content of 20 weight percent and a solids content of 25 weight percent at some point in the heat exchanger. From FIG. 3 it can readily be determined that the pressure in the heat exchanger at this point must be at least 760 mm Hg in order to maintain the polymer solution above the gel profile. Preferably, the pressure at this point is somewhat higher in order to provide a margin for safety. By way of further example, if a polymer solution has, at some point in the heat exchanger 12, a water content of 10 percent and a solids (polymer) content of 20 percent, then the pressure in the heat exchanger at this point must be at least 200 mm Hg in order to maintain the polymer solution above the solution or gel profile. Thus, from this chart a pressure profile for a given polymer solution can readily be determined.

Figure 4:
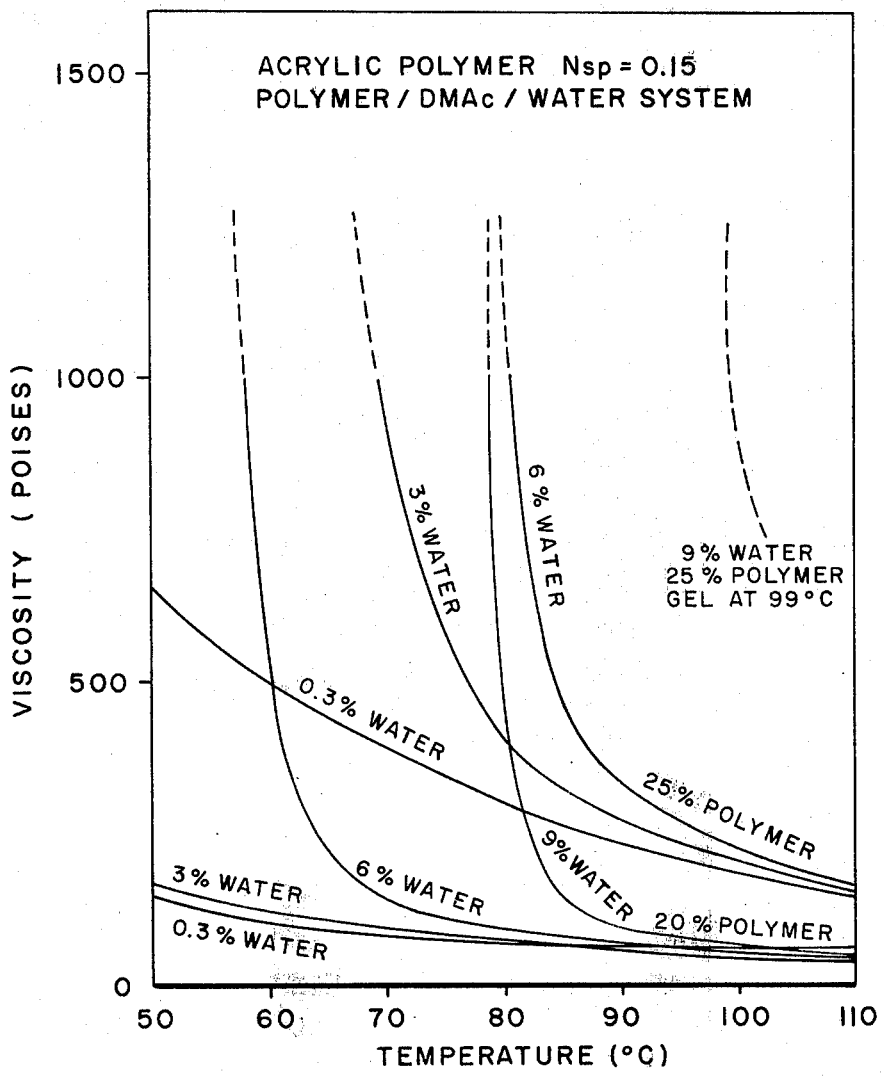
FIG. 4 is a chart showing viscosities of various polymer solutions plotted against temperature.

FIG. 4 shows viscosity plotted against temperature for polymer solutions having 20 percent polymer and 25 percent polymer in varying water contents. This chart shows the rapid increase in viscosity as temperature is lowered or water content of the polymer solution is raised. Higher polymer solution viscosities can reduce the effectiveness of thin film evaporators to a point where these evaporators cannot be used.

Figure 5:
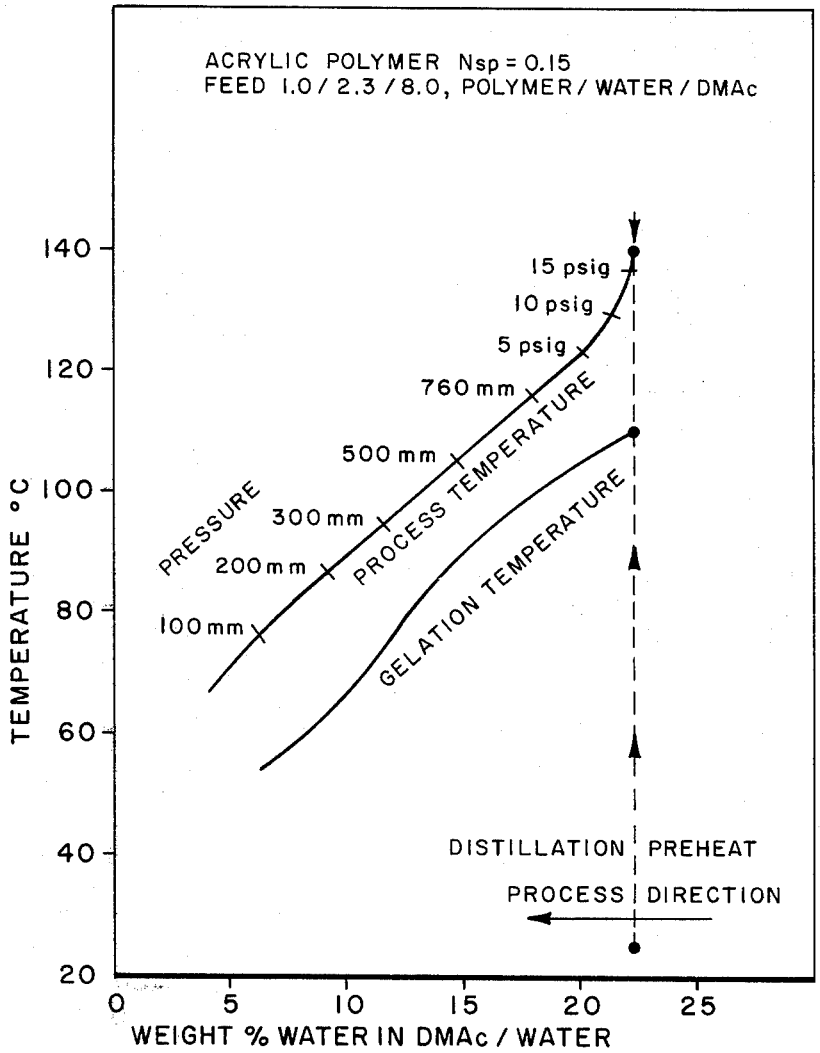
FIG. 5 is a chart showing a suitable pressure profile for a given polymer solution.

FIG. 5 shows a heat exchanger pressure profile for a polymer solution having 1.0 part polymer, 2.3 parts water and 8.0 parts dimethylacetamide, all parts by weight. The polymer solution is preheated until the polymer is in complete solution and is then fed into the heat exchanger at a point indicated by the dotted vertical line. The polymer solution enters the heat exchanger at a pressure of about 15 psig, passes through the heat exchanger and then exits from the heat exchanger into the cyclone separator 13 at a pressure of 100 mm Hg. The pressures experienced by the polymer solution passing through the heat exchanger 12 are indicated on the pressure profile (the curve in FIG. 5 indicated by the words "process temperature"). It will be noted that the pressure profile remains above the gel or solution profile (indicated in FIG. 5 by the words "gelation temperature") throughout the heat exchanger.

In the examples set forth below the heat exchanger used 12 consisted of four sections of tubing heated by the steam jacket 14 and connected in series with pressure gauges and thermometers at the entrance, exit, and between adjacent sections. Wet polymer cake and dimethylacetamide were mixed in a slurry tank and, after being preheated to "Inlet" conditions, were fed to the heat exchanger at a feed rate of 55 $cm^3$/minute. The first and second sections of the heat exchanger were one-fourth inch O. D. stainless steel tubing and the third and fouth sections were three-eighths inch O. D. stainless steel tubing, each having a heated length of 60 inches. The exit from the heat exchanger 12 was connected to a small cyclone type separator 13 to separate the vapor and liquid phases. The liquid phase fell by gravity and was removed by the pump 16. The vapor went overhead, was condensed in the water cooled condenser 17 and collected in the condensate receiver 18.

EXAMPLE I

A slurry was made containing 71 percent by weight dimethylacetamide (DMAC), 20 percent water and 9 percent polymer (an acrylic polymer with an $N_{sp}$ of 0.15). Steam pressure on the jacket was set at 33 psig. and separator pressure at 300 mm Hg absolute. Then the slurry feed was started at a feed rate of 50 $cm^3$/minute. The process conditions at each section of the heat exchanger were as follows:

Table 1

| | Inlet | After 1st Sect. | After 2nd Sect. | After 3rd Sect. | After 4th Sect. |
|---|---|---|---|---|---|
| Pressure | 10 psig | 6 psig | 0 psig | 0 psig | 300 mm Hg |
| Temp. | 25°C | 123°C | 116°C | 111°C | 102°C |
| % Water Liq. | 22.3% | 21.0% | 17.5% | — | 6.5% |
| % Polymer | 9.0% | 9.4% | 9.9% | — | 17.4% |

The polymer solution was not discolored but had the same color as solutions prepared in a conventional manner.

EXAMPLE II

The separator pessure was reduced to 200 mm Hg and steam jacket pressure was adjusted to 30 psig to give the required temperature profile and the desired water and polymer content, using the polymer solutions set our in Example I. Process conditions at each section of the heat exchanger are given in Table 2.

Table 2

| | Inlet | After 1st Sect. | After 2nd Sect. | After 3rd Sect. | After 4th Sect. |
|---|---|---|---|---|---|
| Pressure | 9 psig | 4 psig | 0 psig | 650 mm Hg | 200 mm Hg |
| Temp. | 25°C | 123°C | 117°C | 113°C | 93°C |
| % Water Liq. | 22.3% | 17.5% | 16.5% | 15% | 6.0% |
| % Polymer | 9.0% | 9.9% | 10.1% | 10.4% | 18.6% |

The polymer solution obtained from this process was clear and not discolored.

EXAMPLE III

The pressure separator was reduced to 150 mm Hg and steam jacket pressure was reduced to 22.5 psig. to give the required temperature profile and the desired water and polymer content, using the slurry of Example I. Process conditions at each section of the heat exchanger are given below in Table 3.

Table 3

| | Inlet | Exit 1st Sect. | Exit 2nd Sect. | Exit 3rd Sect. | Exit 4th Sect. |
|---|---|---|---|---|---|
| Pressure | 7 psig | 2 psig | 700 mm Hg | 570 mm Hg | 150 mm Hg |
| Temp. | 25°C | 118°C | 114°C | 108°C | 85°C |
| % Water Liq. | 22.3% | 17.5% | 15.5% | 14.0% | 6.0% |
| % Polymer | 9.0% | 9.9% | 10.3% | 10.7% | 18.6% |

Polymer solution was again clear and not discolored.

EXAMPLE IV

The separator pressure was lowered to 100 mm Hg and steam jacket temperature was lowered to 17 psig to give the required temperature profile and the desired water and polymer content, using the slurry of Example I. Heat exchanger conditions are given below in Table 4.

Table 4

| | Inlet | Exit 1st Sect. | Exit 2nd Sect. | Exit 3rd Sect. | Exit 4th Sect. |
|---|---|---|---|---|---|
| Pressure | 3 psig | 1 psig | — | 450 mm Hg | 100 mm Hg |
| Temp. | 25°C | — | 103°C | 99°C | 77°C |
| % Water Liq. | 22.3% | — | — | 16.0% | 6.0% |
| % Polymer | 9.0% | — | — | 10.2% | 18.6% |

The polymer solution was clear and not discolored.

Vaporization of the water takes place in the heat exchanger 12, with the separator 13 serving to separate the liquid phase from the vapor phase. Thus, the polymer or spinning solution going to the gear pump 16 will have the water and polymer contents shown in the "Exit 4th Sect." columns in the tables. It has been found that acrylic spinning solutions containing small amounts of water can be successfully spun into fibers without difficulty.

What is claimed is:

1. The method of making a spinning dope, comprising a. mixing a mixture of water and a filament forming acrylonitrile-containing polymer with a solvent for said polymer to form a slurry, said polymer containing at least 35 weight percent acrylonitrile, said slurry being made up of 5 to 30 weight percent polymer, up to 20 weight percent water and 70 to 80 weight percent solvent, said solvent being selected from the group consisting of dimethylacetamide, dimethylformamide and dimethylsulfoxide, b. heating the slurry under a pressure and at a temperature and time sufficient to dissolve the polymer in the solvent to form a polymer solution, said heat and pressure being sufficient to raise the temperature of the solution to a point above the gel profile of said solution, and then c. passing the polymer solution through a vaporization zone to remove a major portion of the water therefrom, said zone having a pressure which is lowered along the zone in such a manner that the pressures at points in said zone define a pressure profile which decreases along said zone, said pressure profile being sufficiently high to vaporize the water from the polymer solution while maintaining the polymer solution above the gel profile of said solution throughout said zone.

2. The method of claim 1 wherein the slurry contains 8 to 12 weight percent polymer, 12 to 17 weight percent water and 73 to 77 weight percent solvent.

3. The method of claim 2 wherein the solvent is dimethylacetamide.

* * * * *